United States Patent [19]

Hsu et al.

[11] Patent Number: 4,878,278

[45] Date of Patent: Nov. 7, 1989

[54] METHOD FOR MANUFACTURE OF PAPER MAKING FABRICS

[75] Inventors: Chien-Yeh Hsu, Greer; Frank J. McGee, Seneca; Roger L. Banks, Taylors, all of S.C.

[73] Assignee: Wangner Systems Corporation, Greenville, S.C.

[21] Appl. No.: 188,296

[22] Filed: Apr. 29, 1988

Related U.S. Application Data

[63] Continuation of Ser. No. 81,750, Aug. 5, 1987, abandoned.

[51] Int. Cl.[4] ..... D04H 1/46

[52] U.S. Cl. ..... 28/142; 28/110; 28/114

[58] Field of Search ..... 28/110, 111, 114, 142

[56] References Cited

U.S. PATENT DOCUMENTS

| | | | |
|---|---|---|---|
| 3,150,434 | 9/1964 | O'Byrne | 28/114 |
| 3,166,823 | 1/1965 | Bernard | 28/110 |
| 3,508,307 | 4/1970 | Dilo | 28/110 |
| 3,673,024 | 6/1972 | Eriksson | 28/110 X |
| 3,849,223 | 11/1974 | Kent | 28/111 X |
| 3,952,126 | 4/1976 | Dycks | 28/111 X |
| 4,378,618 | 4/1983 | Dilo | 28/110 |
| 4,454,637 | 6/1984 | Dilo | 28/110 |
| 4,536,927 | 8/1985 | Feyerl et al. | 28/110 |
| 4,701,986 | 10/1987 | Feyerl et al. | 28/110 X |
| 4,777,706 | 10/1988 | Stanislaw | 28/110 |

FOREIGN PATENT DOCUMENTS

| | | | |
|---|---|---|---|
| 2324985 | 1/1974 | Fed. Rep. of Germany | 28/110 |
| 46-3315 | 1/1971 | Japan | 28/110 |

*Primary Examiner*—Robert R. Mackey
*Attorney, Agent, or Firm*—Cort Flint

[57] ABSTRACT

An apparatus and method for papermaking fabrics (W) with a machine direction fiber batt (24) is disclosed. A carding machine (B, B') is arranged with its carding cylinder (39) parallel to the axis of rotation (22) of carriage rollers (20) about which a base fabric (16) travels in a machine direction. A carded batt (24) with fibers (36) oriented in the machine direction is fed directly in the machine direction onto base fabric (16). An auxiliary needling unit (A) including an auxiliary needling module (44) lightly tacks machine direction batt (24) to base fabric (16) across its width. For this purpose, carding machine (B) and base fabric (16) move relative to one another in a direction transverse to the machine direction. In one embodiment, card (B) moves transversely in synchronization with auxiliary needling unit (A) while carriage (18) carrying the base fabric is stationary. In an alternate embodiment, carding machine (B') and auxiliary needling unit (A') are stationary while carriage (18') moves transversely to deposit machine direction oriented batt (24) in strips across the base fabric. Upon completion of tacking the machine direction batt, the composite is passed beneath main needling modules (12) of a needling loom (10). Machine direction batt (24) is tucked fully into base fabric (16) by further needling on needle loom (10).

6 Claims, 3 Drawing Sheets

Fig. 3.
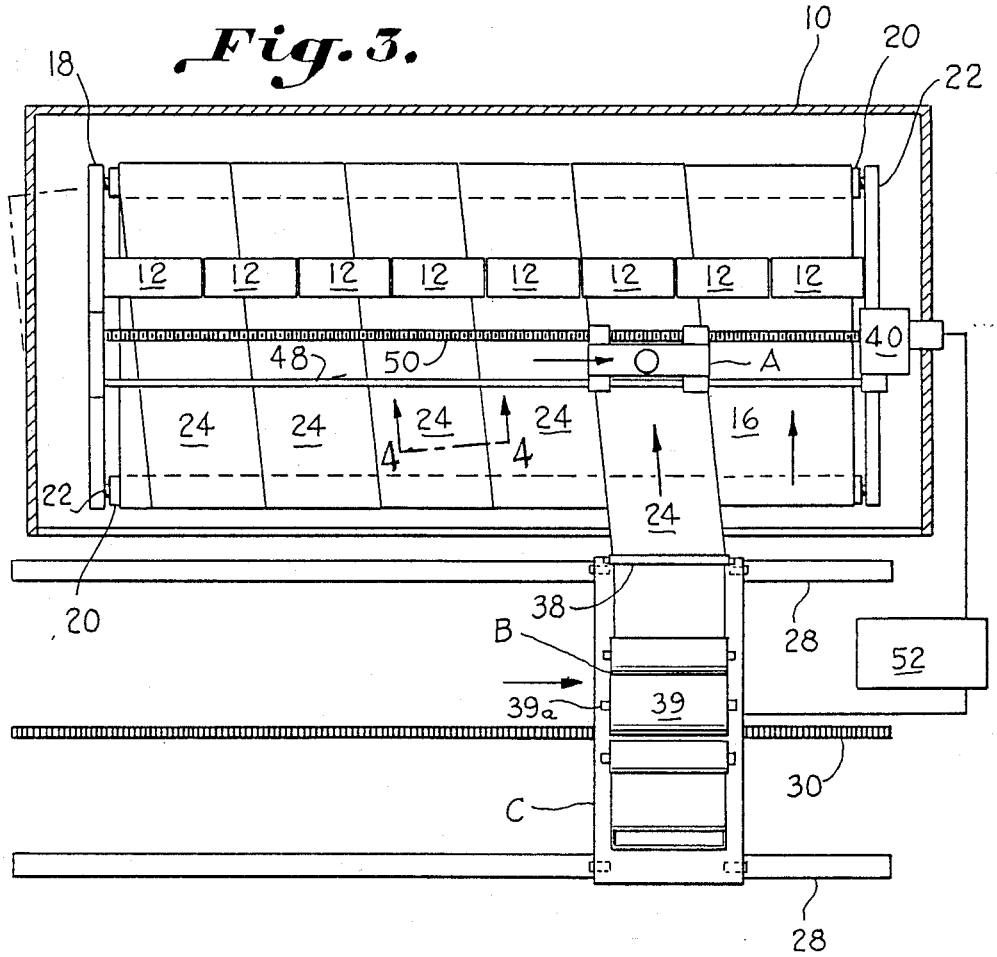
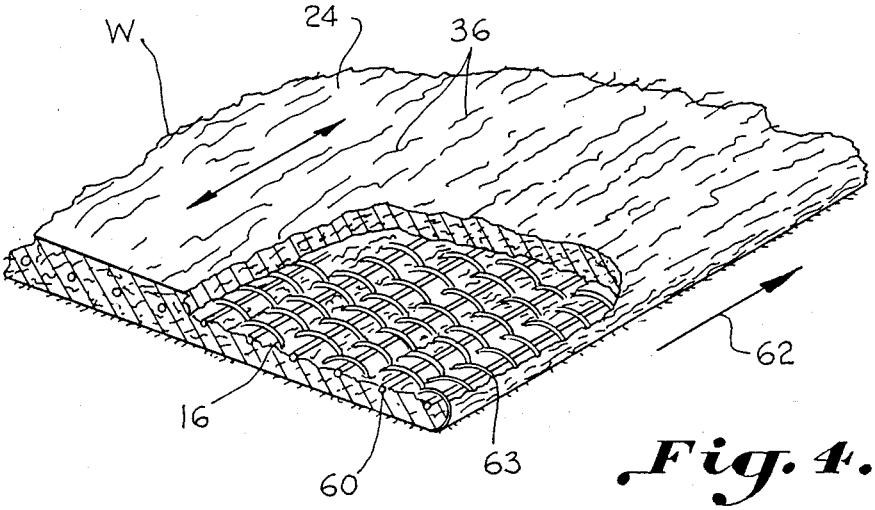
Fig. 4.

Fig. 5.
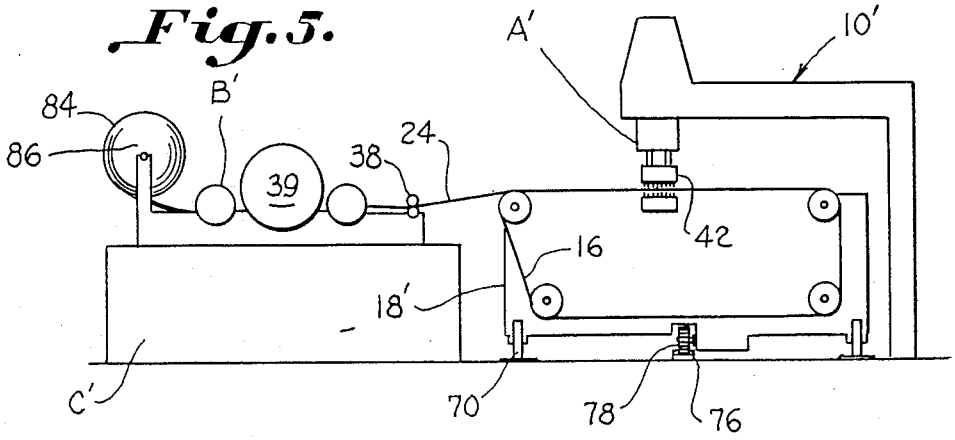
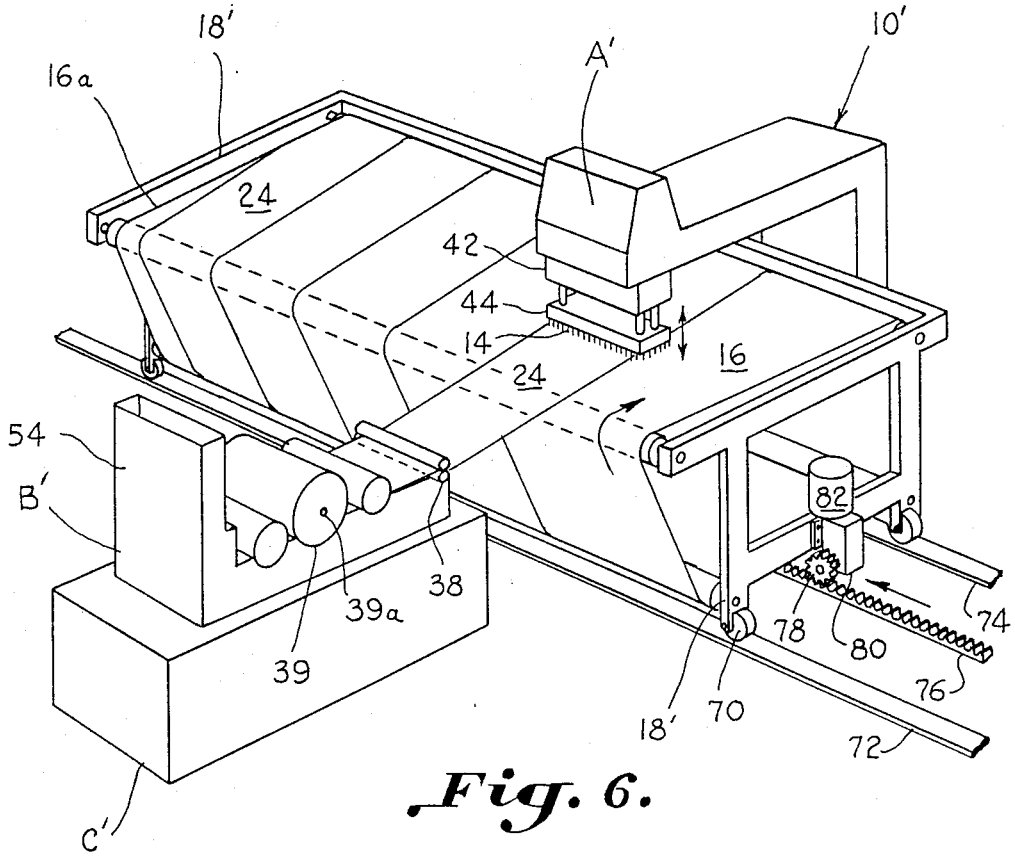
Fig. 6.

METHOD FOR MANUFACTURE OF PAPER MAKING FABRICS

This is a continuation of copending application Ser. No. 081,750, filed on Aug. 5, 1987, now abandoned.

BACKGROUND OF THE INVENTION

This invention relates to manufacture of papermaking fabrics and particularly to wet felts and occasionally dryer fabrics.

Over the years, papermakers have used the developments in wet felt design to improve water removal in the presses of papermaking machinery. With the advent of monofilament and multifilament yarns in the 1960's, "batt-on-bare" and "batt-on-mesh" designs were introduced. In these designs, carded batts are needled into woven base fabrics.

Conventionally, several layers of batt are cross-lapped onto the base fabric in the cross-machine direction. For example, see U.S. Pat. No. 3,257,259. When the batts are cross-lapped upon the base fabric for needling, the fibers are generally oriented in the cross machine direction rather than the machine direction. The starting line and ending line of the batt laying process forms a butt joint across the width of the fabric. This joint causes vibrations when passing through the press rolls. This problem is more acute when a pre-needled batt is used. In the case of wet felts, water must be pressed from the felt for water removal from the paper fiber matt. Cross-machine oriented fibers are thought to restrict the lateral movement of the water and adversely affect water removal from the sheet.

In view of these disadvantages of applying the web cross-machinewise, some felt makers have started to investigate the possibility of using batts having machine direction oriented fibers on the felts. The benefits of such batts can be twofold: (1) By eliminating the butt joint in the batt, the tendency of nip roll bounce is greatly reduced; and (2). The surface of such felts is exceptionally smooth and lacks needle marks. This not only enhances the water removal due to more uniform pressure application from the press rolls to the sheet, but also improves the surface quality of the sheet for the lack of needle marks. However, the technology and machinery to orient the batt and fibers on the base in the machine direction has been lagging.

Related U.S. Pat. Nos. 3,879,820 and 3,920,511 disclose a papermaker's felt and method in which the fibers are oriented substantially longitudinally to make a substrate by using numerous transfers of the batt upon aprons, reorientations along tortuous paths, and other batt manipulations in a rather complicated manner. A batt is then needled to the substrate crosswise to the felt travel.

U.S. Pat. Nos. 4,553,289, 1,953,457, and 3,713,933 relate generally to the art of building up fibrous batts either in juxtaposed or superposed relation. In the first two patents, general batts are reoriented 90 degrees by using angularly disposed guide rods so that the resulting batt is aligned lengthwise with a conveyer. These patents are related only generally and not directly to the present invention.

Accordingly, an object of the present invention is to provide an improved method and apparatus for making paper-making fabrics having a machine direction fiber batt in which applicating of the batt onto the base fabric and needling are carried out in a simplistic and efficient manner.

Another object of the invention is to provide a method and apparatus for making a papermakers felt which includes a fiber batt needled into a base fabric and the fibers in the fiber batt extend generally in the machine direction to facilitate water removal as well as to improve the sheet quality.

Another object of the invention is to provide a method and apparatus for making a papermakers felt wherein vibrations caused by the running of a felt on the papermaking machine are reduced.

Still another object of the invention is to provide a wet felt having machine direction oriented fibers which are laid upon a base fabric and needled without excessive fiber manipulation.

SUMMARY OF THE INVENTION

The above objectives are accomplished according to the invention by laying a batt having machine direction oriented fibers onto a base fabric which is then needled into the base fabric by an auxiliary needling module. The auxiliary needling module moves crosswise in advance of the conventional main needling modules. The auxiliary needling module needles the batt to initially tack the fibers into the base fabric. The machine direction batt may be fed directly from a moveable card to the base fabric directly or via an apron. Alternately, the card machine and auxiliary module may be held stationary and the carriage which supports the base fabric may be moved laterally. The machine direction batt may be laid straight and directly onto the base fabric without reorienting the batt or fibers as heretofore proposed. A more homogeneous felt is produced wherein the fibers have not been damaged or reoriented excessively.

In accordance with the invention, an auxiliary needling module is carried adjacently to main needling boards of the needle loom. An apron may convey the machine direction batt to the auxiliary needling module first. The auxiliary needling module needles the batt to lay the batt upon the base fabric initially. After the batt has been laid upon the base fabric it may then be tucked by passing the batt and base fabric through the main needling modules of the needle loom. The needling modules of the conventional loom may be single or double board and/or one on top (face) and one on bottom (inside the felt). A card machine is utilized to feed a carded batt with machine direction fibers to the apron and to the base fabric. The card machine may be carried along a track to move laterally with respect to the base fabric in synchronization with the auxiliary needling module. In this manner, needling of the base fabric without a batt is prevented as would occur if the main needling modules across the width of the fabric were utilized. In another embodiment of the invention, the base fabric may be carried on a mobilized carriage. The auxiliary needling module and the card machine may be stationary. The machine direction batt is fed directly to the base fabric and lightly tacked thereto by the auxiliary needling module. After the batt is needled onto the base fabric, the felt can then be transferred to the main needle loom to finish the needling process.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein examples of the invention are shown and wherein:

FIG. 3 is a top plan view of a method and apparatus according to the present invention for producing a papermaking fabric having a machine direction fiber batt;

FIG. 4 is a sectional view taken along line 4—4 of FIG. 3;

FIG. 5 is a side elevation of an alternate embodiment of apparatus for producing a papermaking fabric having a machine direction fiber batt; and FIG. 6 is a perspective view of the apparatus of claim 5.

DESCRIPTION OF A PREFERRED EMBODIMENT

Figure 1:
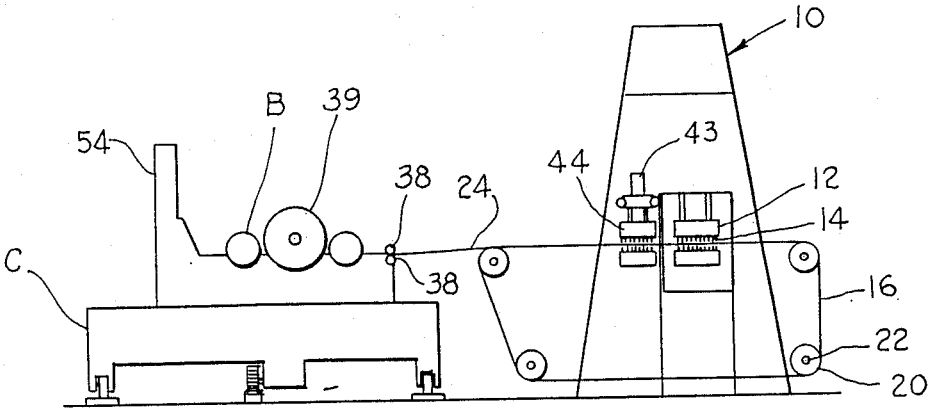
FIG. 1 is a side elevation illustrating a method and apparatus according to the present invention for producing a wet felt with a machine direction batt.
Figure 2:
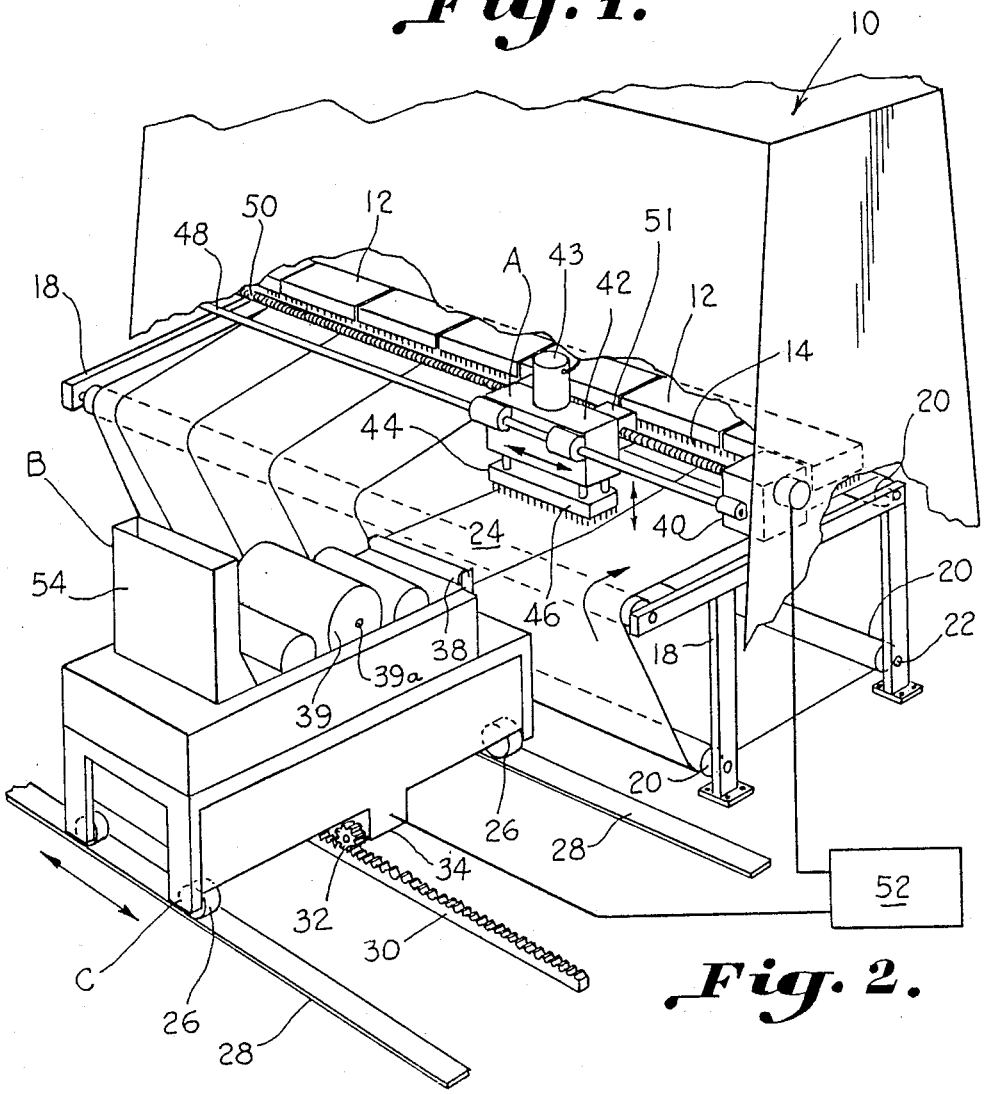
FIG. 2 is a perspective view of the apparatus of FIG. 1.

Referring now in more detail to the drawings, a conventional needle loom is shown at 10 which may be any suitable needle loom such as a needle loom manufactured by the Morrison Berkshire Company of North Adams, Mass. Such a needle loom typically includes a needle board or module 12 having a plurality of needles 14 attached to the needle module which extend downwardly a distance below the bottom surface of each needle module. The needle loom 10 comprises a means (not shown) for moving the needle board in reciprocating motion having a first needling direction and a second needling direction. As well known in the art, the needles in the needle modules are aligned with holes in a bed plate (not shown) over which the fabric to be needled passes. The reciprocating motion of the needle modules forces the needles in and out of the holes in the bed plate and thus in and out of the fabric. The fabric positioned between the needle module and the bed plate is "tucked" or "needled".

Base fabric 16 travels on a carriage 18 which includes four carriage rollers 20, each having an axis of rotation 22. The carriage and needle loom are conventional and only such detail as is necessary for an understanding of the invention will be described herein.

In accordance with the invention, auxiliary needling unit A is carried in advance of main needling modules 12 considering the direction of travel of base fabric 16. The purpose of auxiliary needling unit A will be described in more detail later. A carding machine B produces a carded fiber batt 24 in a conventional manner. Carding machine B is shown fixed to a movable platform C which includes rollers 26 that move along tracks 28. A longitudinal gear rack 30 is engaged by a rotating drive gear 32 to move carding machine B laterally with respect to the longitudinal direction of the travel of base fabric 16. A suitable drive 34 is provided for drive gear 32. This drive 34 may be any conventional, controllable motor drive.

In accordance with the invention, fiber batt 24, with fibers 36 arranged generally straight and parallel, is delivered in the longitudinal direction. Carded fiber batt 24 is produced by main carding cylinder 39 and is conveyed by a pair of delivery rolls 38 directly to base fabric 16 in the machine direction. For this purpose, axis of rotation **39*a* of carding cylinder 39 is parallel to axis of rotation 22 of carriage rollers 20**.

Carding machine B may produce a carded batt in widths up to approximately five feet (5'). The wet felt base fabric will have a width up to 450". Auxiliary needling unit A comprises a reciprocating drive unit 40, a needling drive unit 42, and an auxiliary needling module 44. Conventional needles 46 are carried by needle module 44. Needling drive unit 42 may be a conventionally operated pneumatic arrangement for reciprocating auxiliary needling module 42 up and down by a pneumatic cylinder 43. Alternately, a mechanical arrangement may be utilized like that which drives main module 12. Drive unit 40 conveys needling module 44 in transverse direction relative to the longitudinal direction of base fabric 16 on carriage 18. For this purpose, a guide rod 48 is provided on which module A reciprocates laterally. A threaded drive screw rod 50 is received through and mates with a corresponding threaded drive box 51 to advance auxiliary needling unit A along screw rod 50 in opposing lateral movements. Synchronization between the lateral movements of carding machine B and auxiliary needling unit A is provided by any suitable control unit 52 which is coupled between drive units 40 and 34 of auxiliary needling unit A and carding machine B, respectively. As illustrated, carding machine B is fed with fibers from a conventional chute feed 54 which may be any conventional chute feed such as that disclosed in U.S. Pat. No. 4,476,611. Alternately, the card can be fed by a pre-needled batt rolled up and substituted in place of the chute feed.

Referring now to FIG. 3, the apparatus and method of the present invention will now be described in operation. Auxiliary needling unit A and carding machine B start, for example, at the left side of carriage 18 and base fabric 16. Fiber batt 24 is laid upon base fabric 16 and as it passes beneath auxiliary needling unit A is lightly tacked onto base fabric 16 by auxiliary needling module 44. The process continues and fiber batt 24 is laid upon base fabric 16 across the entire width of base fabric 16. Web 24 is initially tacked onto the base fabric by the synchronous movement of auxiliary needling module 44 across the width of the fabric in synchronization with carding machine B. It will be noted that fiber batt 24 is fed in longitudinal alignment with the direction of travel of fiber batt 24. This longitudinal direction of travel is the machine direction so that fibers 36 in fiber batt 24 will be aligned in the machine direction in wet felt W. If base fabric 16 is woven conventionally, it will be woven in an endless manner. In this case, the weft yarns 60 will extend in the machine direction 62, as can best be seen in FIG. 4. Warp pins 63 extend in the cross-machine direction. The fibers 36 will likewise be generally oriented in the machine direction. The speed of lateral movement and the length of the fabric is synchronized so that for every revolution of the fabric, the needle module and the card move laterally exactly one web width. In this way, the web is being helically wound onto the base fabric as shown in 24, FIG. 6. Since fiber batt 24 is laid in a helical fashion upon base fabric 16, the fiber batt and fibers will not be perfectly aligned in the machine direction.

The "pitch" of the helix is determined by the web width and the fabric length. Since the web width is constant, the pitch is directly related to the fabric length.

An alternate embodiment which involves a less complicated mechanism is illustrated in FIG. 5 and FIG. 6. The machinery consists of a stationary card B', stationary needling module A', and a lateral moving fabric carriage 18'. In this embodiment, base fabric 16 is moving laterally as the machine oriented web 24 is being needled into the fabric. In the concept of "helically wound", the machine direction oriented web is still the same as in the previous embodiment. This alternate method involves a less complicated process in order to synchronize two pieces of equipment. After the web is helically wound and needled into the base fabric, the composite is transferred from this machinery to a conventional full-width needle loom to finish the needling process. Carriage 18' may be supplied with rollers 70 which ride on parallel tracks 72 and 74 for reciprocating lateral movement relative to the longitudinal movement of base fabric 16. An elongated gear rack 76 is parallel to tracks 72 and 74. A drive gear 78 meshes with gear rack 76 and is driven by a drive motor 80 controlled by a suitable control 82.

The card B' can be fed with a chute feeder such as shown in FIG. 1, or with from a preneedled fiber batt 84 from a roll 86 as shown in FIG. 5. Preneedled fiber batt 84 may consist of a fiber batt which has been previously carded and tacked together lightly by needling or other means. In this embodiment, laying on of machine direction batt 24 commences at the side **16*a*** of the base fabric. The batt is initially tacked to the base fabric by auxiliary needling unit A'.

In accordance with the method of the present invention, base fabric 16 is arranged on carriage rollers 20 for endless travel through needle loom 10. A carding machine B' having main carding cylinder 39 is arranged so that axis of rotation **39*a* of the carding cylinder is parallel to an axis of rotation of the carriage rollers. The fiber batt produced on the carding machine is delivered in longitudinal alignment with the travel of base fabric 16** and laid upon the base fabric in the machine direction of wet felt W. The fiber batt and base fabric are moved relative to each other in a manner that the fiber batt is laid upon the base fabric in the machine direction across a prescribed width of the base fabric. the fiber batt is initially tacked onto the base fabric and is oriented in the machine direction. After the fiber batt is tacked across the entire width of the base fabric in an endless manner, the machine direction fiber batt is tucked fully into the base fabric by passing the tacked machine direction batt and base fabric through the main needling modules of a needle loom.

Thus, it can be seen that an advantageous method and apparatus for producing a wet felt can be had in accordance with the invention. A fiber batt can be needled to a base fabric and oriented in the machine direction without the necessity of manipulating the fiber batt or turning the batt at angles for feeding. The fiber batt may be fed directly from the feed rolls of the carding machine in generally a straight line upon the base fabric and wound upon the base fabric across its entire width by moving the machine direction fiber batt and base fabric in lateral, relative movements. After the machine direction fiber batt is lightly tacked onto the base fabric by a synchronously moving auxiliary needling unit, the tacked fiber batt may then be fully needled to the base fabric by the main needling modules of a needle loom.

While preferred embodiments of the invention have been described using specific terms, such description is for illustrative purposes only, and it is to be understood that changes and variations may be made without departing from the spirit or scope of the following claims.

We claim is:

1. A method of producing a papermaking wet felt which travels about press rolls in a machine direction on a papermaking machine, said method being of the type wherein a fiber batt is needled to a base fabric on a needle loom having a main needling module, said method comprising:

(a) conveying a base fabric on a movable carriage about a plurality of carriage rollers for endless travel in said machine direction;

(b) producing a fiber batt on a carding machine having a main carding cylinder with an axis of rotation parallel to an axis of rotation of said carriage rollers so that said fiber batt is delivered generally in longitudinal alignment with the direction of travel of said base fabric;

(c) moving said carriage on which said base fabric travels endlessly in said transverse direction to cause said base fabric to move relative to said fiber batt transverse to said machine direction in a manner that said fiber batt is laid upon said base fabric generally in said machine direction across a prescribed width of said base fabric;

(d) tacking said machine direction oriented fiber batt to said base fabric by needling while said fiber batt is laid upon said base fabric moving in said transverse direction to provide a lightly tacked fiber batt across said width of said base fabric; and (e) transferring said tacked fiber batt to the needle loom and tucking said tacked fiber batt into said base fabric by passing said lightly tacked fiber batt and base fabric through said main needling module of said needle loom for needling.

2. The method of claim 1 including tacking said fiber batt to said base fabric by using an auxiliary needling module fixed relative to said moving carriage.

3. The method of claim 1 including feeding textile fibers to said carding machine from a vertical chute feeder.

4. The method of claim 1 including feeding a pre-needled textile fiber batt to said carding machine, carding said pre-needled fiber batt, and delivering said carded fiber batt to said base fabric.

5. The method of claim 1 wherein said carding machine is maintained stationary while said carriage is moved transversely.

6. A method of producing a papermaking wet felt which travels endlessly between press rolls in a machine direction on a papermaking machine, said method being of the type wherein a fiber batt is needled to a base fabric on a needle loom having a main needling module, said method comprising:

(a) conveying a base fabric upon a plurality of carriage rolls for endless travel on a movable carriage;

(b) feeding a carded fiber batt from a stationary delivery roll having an axis of rotation parallel to the axis of rotation of said carriage rolls in a manner that a fiber batt is delivered and laid upon said base fabric generally in a machine direction;

(c) moving said carriage in a transverse direction parallel to said axis of rotation of said delivery roll to move said base fabric relative to said fiber batt transverse to said machine direction in a manner that said fiber batt is laid upon said base fabric in lateral strips across a prescribed width of said base fabric extending generally in said machine direction;

(d) passing said fiber batt and said base fabric through an auxiliary needling module fixed relative to said movable carriage before processing on said main needling module and lightly tacking said fiber batt onto said base fabric across said prescribed width of said base fabric to provide a tacked fiber batt; and (e) transferring said tacked fiber batt to the needle loom and tucking said tacked fiber batt fully into said base fabric with said main needling module following tacking of said fiber batt with said auxiliary needling module.

* * * * *